US008985337B2

(12) United States Patent
Canon

(10) Patent No.: US 8,985,337 B2
(45) Date of Patent: Mar. 24, 2015

(54) DISPLAY PACKAGING FOR PLUSH TOYS

(75) Inventor: Dennis Patrick Canon, Cerritos, CA (US)

(73) Assignee: Disney Enterprises, Inc., Burbank, CA (US)

( * ) Notice: Subject to any disclaimer, the term of this patent is extended or adjusted under 35 U.S.C. 154(b) by 400 days.

(21) Appl. No.: 12/887,732

(22) Filed: Sep. 22, 2010

(65) Prior Publication Data

US 2012/0067772 A1 Mar. 22, 2012

(51) Int. Cl.
*B65D 73/00* (2006.01)
*A63H 3/50* (2006.01)

(52) U.S. Cl.
CPC ..... *A63H 3/50* (2013.01)
USPC ..... 206/756; 206/457; 297/440.12

(58) Field of Classification Search
USPC ..... 206/756, 764, 457; 446/482; 297/440.12, 217.1, 352
See application file for complete search history.

(56) References Cited

U.S. PATENT DOCUMENTS

| | | | | | |
|---|---|---|---|---|---|
| 840,577 | A * | 1/1907 | Moore | 446/482 |
| 1,548,488 | A * | 8/1925 | Schibrowski | 297/411.41 |
| 2,083,716 | A * | 6/1937 | Klar | 297/294 |
| 2,244,605 | A * | 6/1941 | Benoit | 297/381 |
| 2,276,308 | A * | 3/1942 | Hugh | 446/482 |
| D140,583 | S * | 3/1945 | Brunetti | D21/521 |
| 2,649,146 | A * | 8/1953 | Sanford et al. | 297/411.41 |
| 2,759,527 | A * | 8/1956 | Myrick, Jr. | 297/183.5 |
| 2,762,161 | A * | 9/1956 | Danielson | 446/227 |
| 2,920,683 | A * | 1/1960 | Moster | 297/313 |
| 2,940,511 | A * | 6/1960 | Gomes | 297/440.12 |
| 3,053,569 | A * | 9/1962 | Clark, Jr. | 297/111 |
| 3,290,092 | A * | 12/1966 | Howard | 297/377 |
| 3,359,036 | A * | 12/1967 | Druth et al. | 297/352 |
| 3,583,093 | A * | 6/1971 | Glass et al. | 446/299 |
| 3,664,705 | A * | 5/1972 | Brody et al. | 297/451.4 |
| 3,756,656 | A * | 9/1973 | Weick | 297/451.3 |
| 4,145,084 | A * | 3/1979 | Capper | 297/411.41 |
| 4,648,658 | A * | 3/1987 | Calco | 297/440.12 |
| 4,820,231 | A * | 4/1989 | Mikitka et al. | 40/538 |
| 5,172,806 | A * | 12/1992 | Mickelberg | 206/756 |
| 5,350,058 | A * | 9/1994 | Keough | 220/505 |
| 5,941,599 | A * | 8/1999 | Roberts | 297/115 |
| 6,027,395 | A * | 2/2000 | Strom | 446/274 |
| 7,008,020 | B2 * | 3/2006 | Becker et al. | 297/452.41 |
| 7,257,916 | B2 * | 8/2007 | Hall et al. | 40/672 |
| 7,346,948 | B1 * | 3/2008 | Swezey et al. | 5/653 |
| 2005/0127738 | A1 * | 6/2005 | Robinson | 297/440.13 |
| 2005/0142984 | A1 * | 6/2005 | Kiyosue | 446/296 |
| 2007/0222269 | A1 * | 9/2007 | Stoeckel et al. | 297/392 |
| 2011/0010842 | A1 * | 1/2011 | Ton | 4/621 |

* cited by examiner

*Primary Examiner* — Jacob K Ackun
(74) *Attorney, Agent, or Firm* — Ference & Associates LLC

(57) ABSTRACT

Display packaging for plush toys or dolls that allows the packaged toy to be neatly displayed on a retail shelf in an upright, sitting position so that the toy's features can be readily seen is described. In particular, the display packaging facilitates, and encourages, a child accompanying an adult purchaser at a retail location to hug or cuddle the toy without the display packaging impeding that experience. The display packaging also uses much less packaging material than previous packaging for similar products.

9 Claims, 5 Drawing Sheets

DISPLAY PACKAGING FOR PLUSH TOYS

BACKGROUND

The rapid and virtually unlimited development of toy products within the marketplace has been largely matched by the development of innovative product packaging and product packaging techniques. Toys, for example, have become increasingly entertaining, amusing, colorful and sophisticated and packaging for such toy products have often been developed to make the packaging more colorful, informative, eye-catching and entertaining.

One trend present in the marketplace as it relates to toy packaging can be generally described as providing a "try-me" feature in packaging. Such packaging allows the product to be displayed and supported in a manner that allows and encourages a potential purchaser, or in the case of toys, a child accompanying that potential purchaser, to try out the product in a limited way without removing the product from its packaging. The objective of such packaging therefore is to provide a packaging environment in which the product may be played with or demonstrated while still maintaining the integrity of the packaging and its ability to protect and retain the product.

The display of plush toys or dolls in particular has traditionally posed certain problems due to the fact that the toys are generally haphazardly placed onto a retailer's shelves, or if the toys are neatly arranged they become disarrayed or fall over as customers move them when they are moved and removed from the shelf for purchase. Thus, a neat and orderly display of such toys is desired so as to enhance the appearance of the toys at the point of purchase.

It is also important to maintain a focus on the environmental impact of packaging, i.e., the particular materials used and whether they are used minimally so as to respond to environmental concerns.

BRIEF SUMMARY

Broadly contemplated herein, at least one presently preferred embodiment is directed to display packaging for plush toys which allows the toy to sit upright on a retail display shelf, however such packaging does not present any restriction or obstruction so that the toy can be picked up and cuddled by, for example, a child accompanying the ultimate purchaser.

In summary, one embodiment provides display packaging that defines a seat enclosure for a toy comprising a low back support strip connected perpendicularly at both ends to curved sides that emulate chair arms that are in turn each attached perpendicularly to each side of a seat bottom. The seat bottom is broadly elliptical in its front area so as to minimally cover only the bottom of the toy's body that is sitting thereon thereby allowing the legs of the toy to fall downward when the packaged toy is picked up, allowing the toy to be hugged or cuddled. The back support strip is spaced above and parallel to the seat bottom thereby allowing the toy's tail, if any, to also hang down the back of the packaging when the toy in its packaging is removed from the retail shelf. For display purposes the display packaging containing the toys may stand on a retail shelf in an orderly manner.

For a better understanding of exemplary embodiments together with other and further features thereof, reference is made to the following description, taken in conjunction with the accompanying drawings, and the scope of the claimed embodiments will be pointed out in the appended claims.

DETAILED DESCRIPTION

It will be readily understood that the components of the embodiments, as generally described and illustrated in the figures herein, may be designed in a wide variety of different configurations in addition to the described exemplary embodiments. Thus, the following detailed description of the embodiments, as represented in the figures, is not intended to limit the scope of the claims, but is merely for illustration of certain selected exemplary embodiments as claimed herein.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of the embodiments. One skilled in the relevant art will recognize, however, that the various embodiments can be practiced without one or more of the specific details, or with other methods, components, materials, et cetera. In other instances, well-known structures, materials, or operations are not shown or described in detail to avoid obscuring aspects of the embodiments.

The present invention is directed to display packaging for plush toys or dolls that allows the packaged toy to be neatly displayed on a retail shelf in an upright, sitting position so that the toy's features can be readily seen. In particular, the display packaging facilitates, and encourages, a child accompanying an adult purchaser at a retail location to hug or cuddle the toy without the display packaging impeding that experience. The display packaging also uses much less packaging material than previous packaging for similar products.

Figure 1:
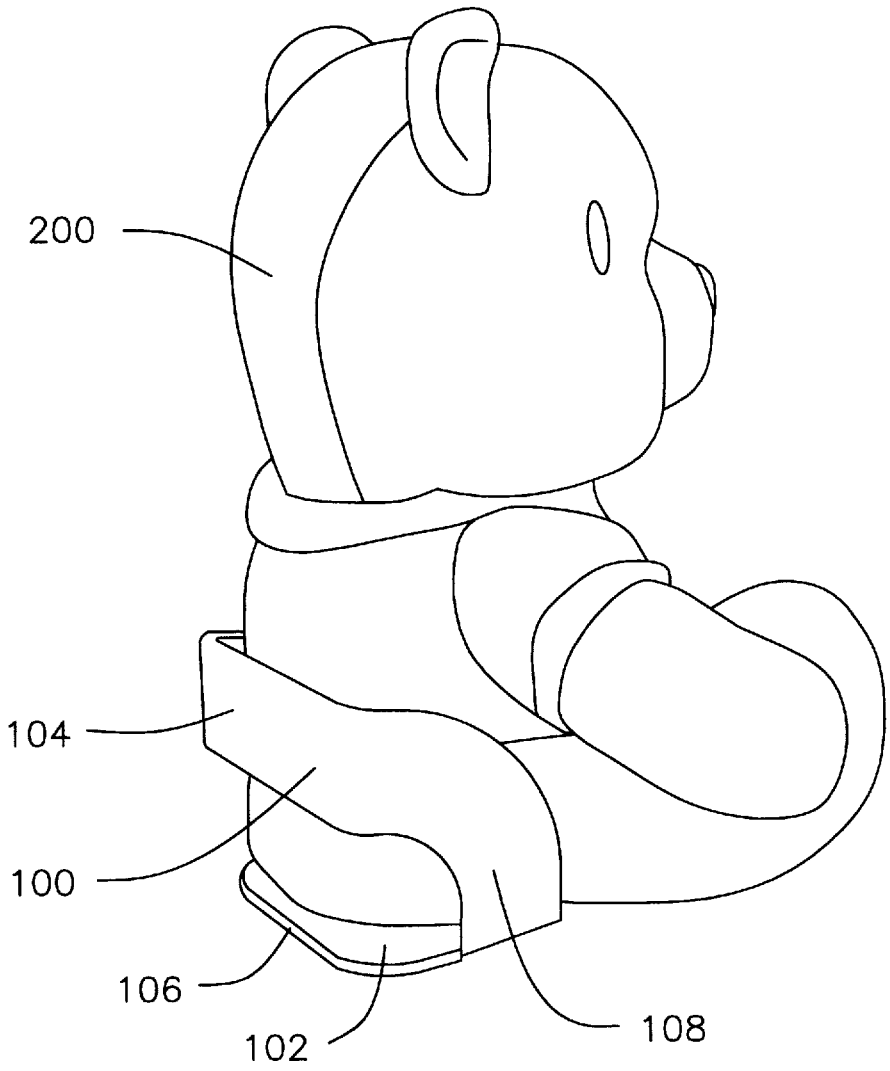
FIG. 1 shows a three-quarters side view of display packaging containing a toy.
Figure 2:
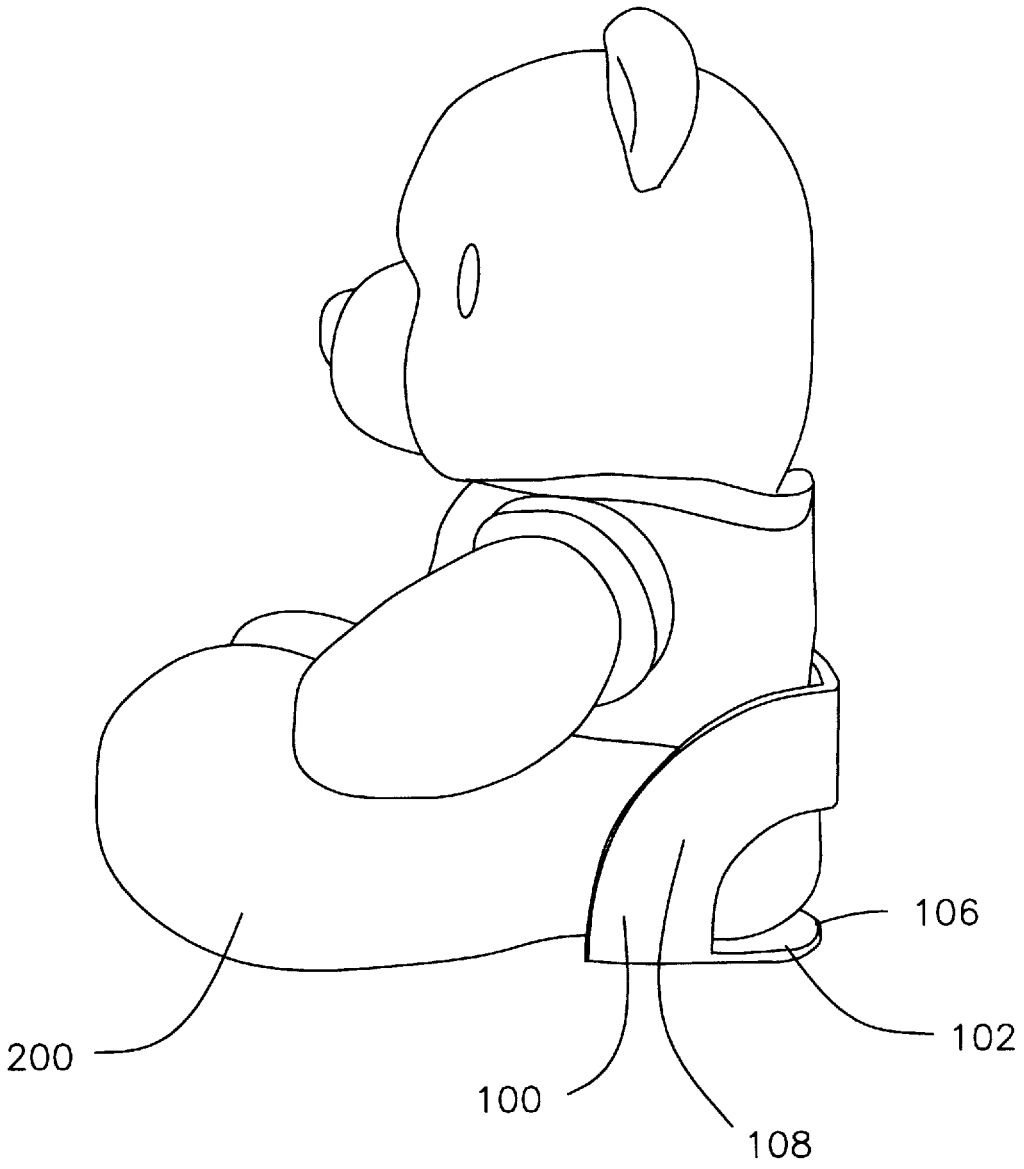
FIG. 2 shows a side view of the display packaging shown in FIG. 1.

As shown in FIG. 1, one embodiment of the display package or packaging 100 is shown as it would sit on a shelf at a retail store with a plush toy 200 housed within. Seat bottom 102 is generally flat and is configured with rounded back edges. Seat bottom 102 has a length that extends as far as the rear edge of back support strip 104 such that the rear edge 106 of seat bottom 102 is spatially aligned below back support strip 104. Back support strip 104 folds inwardly perpendicularly at both sides of the toy's body to thereby form downwardly sloping curved sides 108, that are akin to chair arms, that are each attached perpendicularly to the sides of seat bottom 102. As additionally shown in FIG. 2, toy 200 sits on the seat bottom 102 within the area formed by back support strip 104 and curved sides 108 which together provide stiff and stationary boundaries for the toy in addition to providing a location to secure the toy to the packaging with one or more tags or the like.

The materials for making the display packaging disclosed herein are not limited, but preferably flat suitable material such as, but not limited to, corrugated cardboard, paper, or any other substantially rigid and/or resilient material may be used. The surface of such materials may be capable of receiving or including graphical designs, a product description, trademark(s), bar code, or other indicia or printed material.

Figure 3:
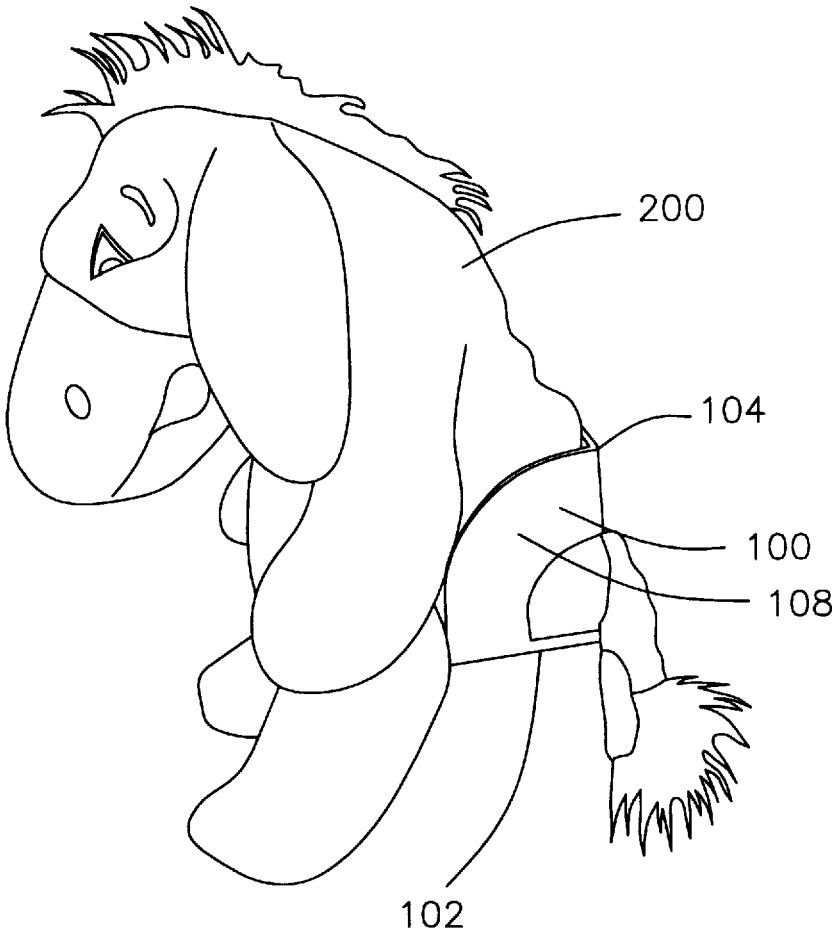
FIG. 3 shows a side view of the display packaging shown in FIG. 1 as it would sit on a retail shelf.
Figure 4:
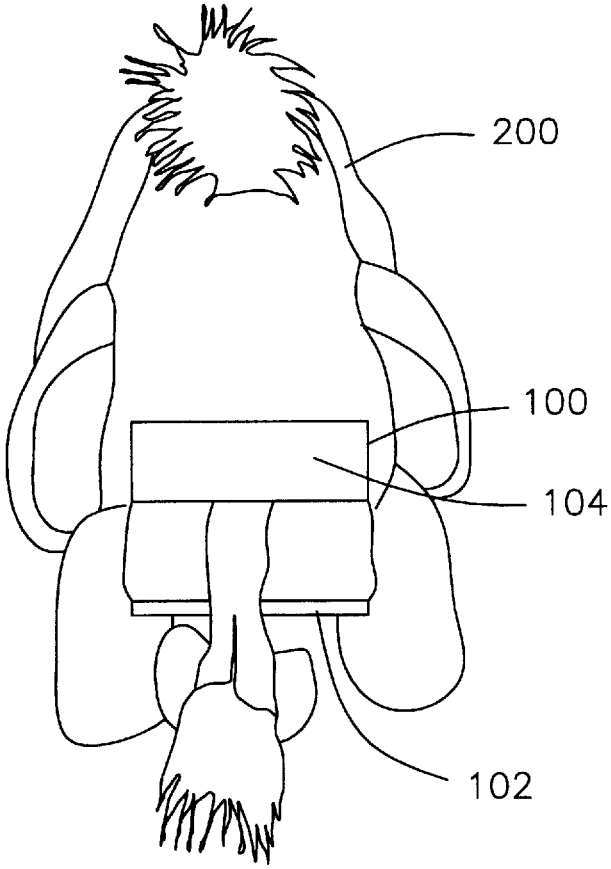
FIG. 4 shows a rear view of the display packaging shown in FIG. 1 showing the tail of the toy.
Figure 5:
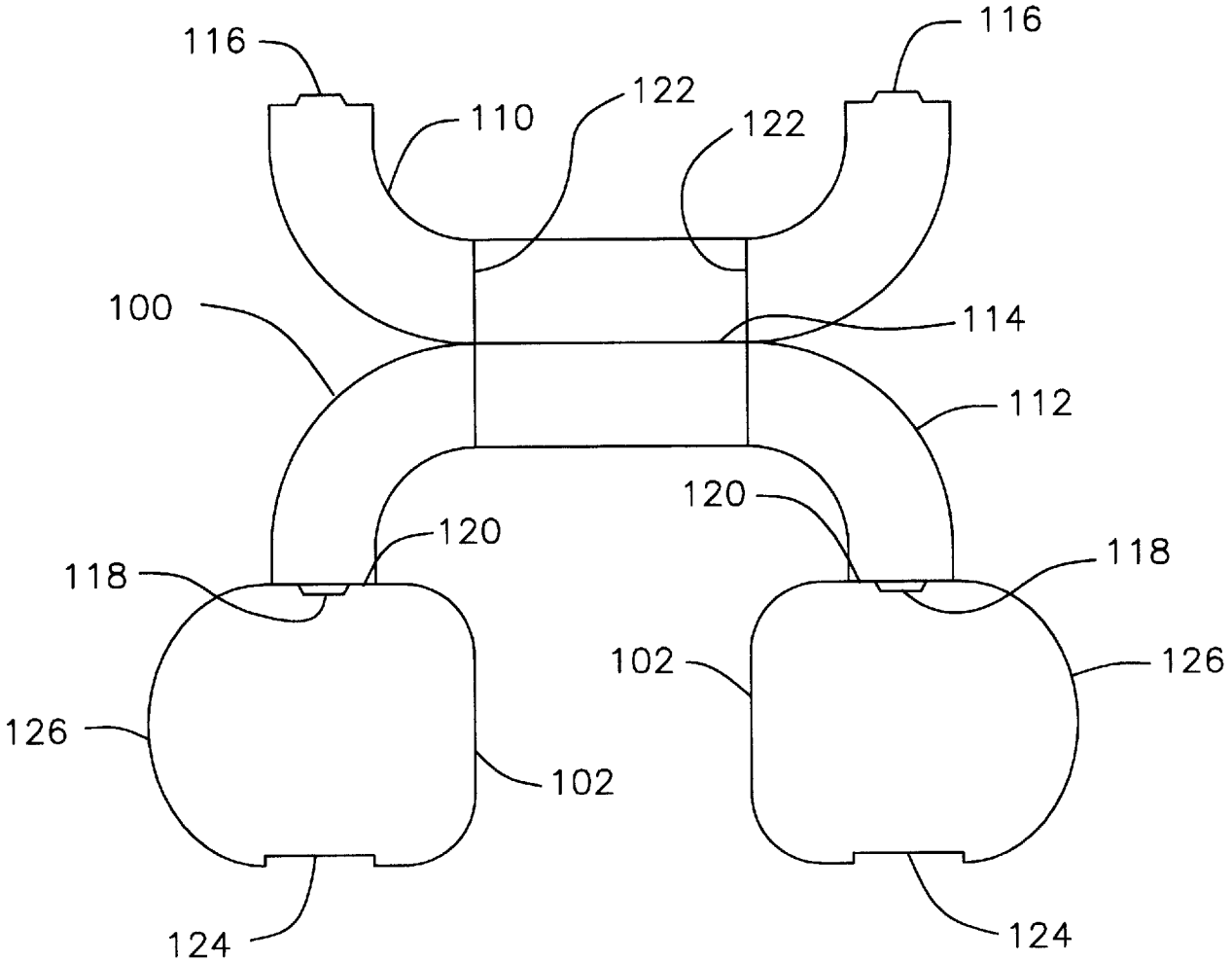
FIG. 5 is a schematic drawing illustrating the structure of display packaging.

As shown in FIGS. 3 and 4, the legs of a toy animal 200 housed within display packaging 100 freely hang down as does the tail of the toy, if any. The front edge of the seat bottom 102 (as shown in FIG. 5) is substantially elliptical, thereby eliminating any hard or protruding edges or corners that would prevent the toy's legs from falling or hanging freely when the toy so packaged is picked up or placed on the front edge of a retail store shelf. The unrestricted leg movement of the toy within the display packaging and the lack of hard or protruding edges or sharp corners results in the toy being able to be picked up and hugged or cuddled by a child accompanying a purchaser at a retail store while the toy is still housed within display packaging 100. Any tails of toys are able to hang down freely due to the opening formed between the seat bottom 102 and the back support strip 104.

As an example of the process or method of making display packaging 100, FIG. 5 shows a diagram of display packaging 100 as it would appear as it is stamped or embossed on a suitable flat sheet of packaging material, preferably corrugated cardboard of 13"×11.5" dimension that is thick enough to support the toy and be folded as described herein. Larger or smaller versions of display packaging for correspondingly larger or smaller toys may be stamped/embossed on other suitable sizes of packaging material that are large enough to accommodate the design of the display package while avoiding excess waste. The reverse side of the packaging material is printed with appropriate graphics, et cetera, as stated above. Upper curved section 110 of display packaging 100 is folded onto its mirror image, lower curved section 112, at fold line 114. When the two curved sections are mated by such folding, tabs 116 on the ends of upper curved section 110 are fastened within fastening slots 118 which are positioned on fold lines 120 at the bottom edge of each arm of lower curved section 112. Tabs 116 are preferably also taped after being fastened within fastening slots 118 to provide additional closure support. Seat bottom sections 102 on the remaining side of each fold line 118 are each folded perpendicularly with respect to the folded over curved section 110. Folding the doubled curved section 110 inwardly along fold lines 122 causes the two seat bottom sections 102 to be superimposed over each other to form seat bottom 102 shown in the previous figures. The seat bottom sections are preferably glued or taped together and have notches 124 which fit around and engage the edges of the curved sections as they meet the sides of the seat bottom. Tape may also be used as additional support where needed on the display packaging. Simultaneously, the folding of curved section 110 along fold lines 122 thereby forms back support strip 104 and curved sides 108 which are perpendicular to support back strip and seat bottom 102. Outer curved surfaces 126 of each bottom section are preferably generally elliptical in shape and form the front bottom edge of seat bottom 102 of display packaging 100 which allows the legs of a toy sitting thereon to fall down freely and dangle or hang when they are not otherwise supported, such as when the toy is picked up.

The dimensions of the display packaging can generally be of any size but preferably two sizes are contemplated, a medium size wherein the packaging height is 3.5", the seat bottom 102 is 4.5" long and 4" wide and the back support strip 104 is 4" wide, and a small size wherein the packaging height is 2.5", the seat bottom 102 is 2.5" long and 3" wide and the back support strip 104 is 3" wide. Of course, as described above, any size of display packaging is contemplated herein to accommodate various sizes of toys.

It will be readily appreciated that the display packaging uses very little packaging material, preferably corrugated cardboard, and eliminates any freestanding box. Thus the present packaging offers an improvement with respect to conservation.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments have been described herein with reference to the accompanying drawings, it is to be understood that the embodiments are not limited to those particular descriptions, and that various other changes and modifications may be affected therein by one skilled in the art without departing from the scope or spirit of the disclosure.

What is claimed is:

1. Display packaging for plush toys, comprising:

a single, foldable piece of material having:

upper and lower curved sections that when folded form into two curved sides, the upper and lower curved sections substantially mirroring one another such that when folded about a fold line form a curved section having a first curved arm and a second curved arm joined together by a back support strip; and a seat bottom section formed of a first piece of material that when folded extends between arms of the curved section;

the arms of the curved section each being attached to a respective opposing side of said seat bottom and facing each other after folding such that the arms extend upwards from said seat bottom and are joined to one another via said back support strip.

2. The display packaging of claim 1, wherein said seat bottom is curved in an approximate elliptical shape that supports only the bottom of said toy.

3. The display packaging of claim 1, wherein said curved section having a first curved arm and a second curved arm joined together by a back support strip, on further folding, defines an aperture bounded by the back support strip, said arms extending therefrom, and is disposed above said seat bottom.

4. The display packaging of claim 1, wherein said single, foldable piece of material is a single piece of corrugated cardboard.

5. The display packaging of claim 1, wherein said curved sides, upon folding, are positioned between upper appendages and opposing sides of a plush toy so as to hold said plush toy in an upright seated position on said seat bottom.

6. A system, comprising:

a plush toy product; and a single, foldable piece of material having:

upper and lower curved sections that when folded form into two curved sides, the upper and lower curved sections substantially mirroring one another such that when folded about a fold line form a curved section having a first curved arm and a second curved arm joined together by a back support strip; and a seat bottom section formed of a first piece of material that when folded extends between arms of the curved section;

the arms of the curved section each being attached to a respective opposing side of said seat bottom and facing each other after folding such that the arms extend upwards from said seat bottom and are joined to one another via said back support strip.

7. The system of claim 6, wherein said plush toy product comprises an animal having rear legs.

8. The system of claim 7, wherein a front edge of said seat bottom has a curved edge so as to not support said rear legs of said plush toy product thereby allowing said rear legs to extend downwardly when not otherwise supported.

9. The system of claim 7, wherein said display packaging is constructed of corrugated cardboard.

* * * * *